United States Patent [19]

Sodergard

[11] Patent Number: 5,011,370

[45] Date of Patent: Apr. 30, 1991

[54] CENTRIFUGAL PUMP

[75] Inventor: Bengt Sodergard, Vasby, Sweden

[73] Assignee: ITT Corporation, New York, N.Y.

[21] Appl. No.: 475,461

[22] Filed: Feb. 5, 1990

[30] Foreign Application Priority Data

Apr. 27, 1989 [SE] Sweden ..... 8901534

[51] Int. Cl.[5] ..... F03B 11/08

[52] U.S. Cl. ..... 415/121.1

[58] Field of Search ..... 415/121.1, 228, 170.1

[56] References Cited

U.S. PATENT DOCUMENTS

| | | | |
|---|---|---|---|
| 111,026 | 1/1871 | Williams | 415/121.1 |
| 1,448,174 | 3/1923 | Young | 415/228 |
| 3,692,422 | 9/1972 | Girardier | 415/121.1 |
| 3,936,758 | 6/1976 | Morgan | 415/121.1 |
| 4,640,666 | 2/1987 | Sodergard | 415/121.1 |

FOREIGN PATENT DOCUMENTS

| | | | |
|---|---|---|---|
| 2452548 | 5/1975 | Fed. Rep. of Germany | 415/121.1 |
| 38396 | 3/1983 | Japan | 415/121.1 |

*Primary Examiner*—John T. Kwon

*Attorney, Agent, or Firm*—Menotti J. Lombardi

[57] ABSTRACT

The centrifugal pump having a closed type impeller with two cover discs and vanes therebetween. The inner parts of the vanes cooperate with a non-rotating insert part for cutting within the pump inlet. The lower cover disc together with the non-rotating insert part in the pump inlet creates a radial seal.

3 Claims, 3 Drawing Sheets

CENTRIFUGAL PUMP

BACKGROUND OF THE INVENTION

This invention concerns a centrifugal pump for pumping liquids containing solid bodies, such as rags and other elongated objects.

A centrifugal pump, which sucks the liquid into its center and throws it outwards in the direction of the periphery, has no problems when pumping clean liquids. However, when the liquid contains solid bodies, the problems arise due to the fact that the bodies may get stuck between the pump impeller and the surrounding pump housing, causing a stoppage or at least a decreased pumping action.

One way to solve this problem is to design the pump in such a manner that the impeller rotates beside the flow itself, a so-called vortex type impeller. In this manner the clogging problems may be essentially removed, however, there are other disadvantages, such as a decreased pump efficiency.

Another method used to solve this problem, is to arrange some form of cutting means in front of the impeller which cuts rags and the like, so as to make it possible to pump these bodies. An example of such a solution is shown in the U.S. Pat. No. 4,108,386.

In the known construction the front end of the impeller is provided with two cutting means which cooperate with the inlet of the impeller for cutting the pollutions. However, the under pressure in the pump inlet enables an incoming rag to get sucked into the center of the impeller. Smaller rags may then rotate together with the impeller without making contact with the cutting means. Bigger rags may cause an increasing rotary resistance, sometimes to such a degree that the pump stops.

Another known construction is shown in the Swedish published patent application No. 444,969. Here a central body with cutting means is arranged, which body fills up the space in the inlet, thus diminishing the disk for one rags being sucked into the impeller center. This solution normally works very well, but under certain conditions a rag may stick to the center of the impeller and get stretched outwards to the periphery between the impeller and the housing. The friction which derives from that might lead to an overload of the motor and release of the motor protection device.

The two described impellers are similar in that they are both a so-called open type. This means that the impeller has only one cover disc on which the vanes are mounted and that the impeller is open towards the cutting means. The prevailing opinion has been that only open impellers are possible to use when pumping strongly polluted liquids. But, the closed impeller, which is provided with two cover discs and vanes therebetween, has an advantage in that its efficiency is far better than that of an open impeller.

According to the invention, use of a closed impeller when pumping strongly polluted liquids has been made possible. This possibility allows better efficiency and a longer bearing life. In addition it provides a better cutting result, thus diminishing the risks of clogging and damage.

SUMMARY OF THE INVENTION

An object of the invention is to provide an improved centrifugal pump for pumping polluted liquids.

According to the broader aspects of the invention, the centrifugal pump comprises an impeller (6) having two cover discs (11) and (12) respectively and vanes (13) therebetween. The inner parts of the vanes (13) cooperate with cutting means (5) within the pump inlet, while the lower cover disc (12) together with a non-rotating insert part (4) in the pump inlet create a radial seal, which prevents medium from entering beside of the impeller (6).

BRIEF DESCRIPTION OF THE DRAWINGS

Other objects and advantages of the present invention will become more fully apparent from the following detailed description taken in conjunction with the accompanying drawings in which.

DETAILED DESCRIPTION OF THE PREFERRED EMBODIMENT

Figure 1:
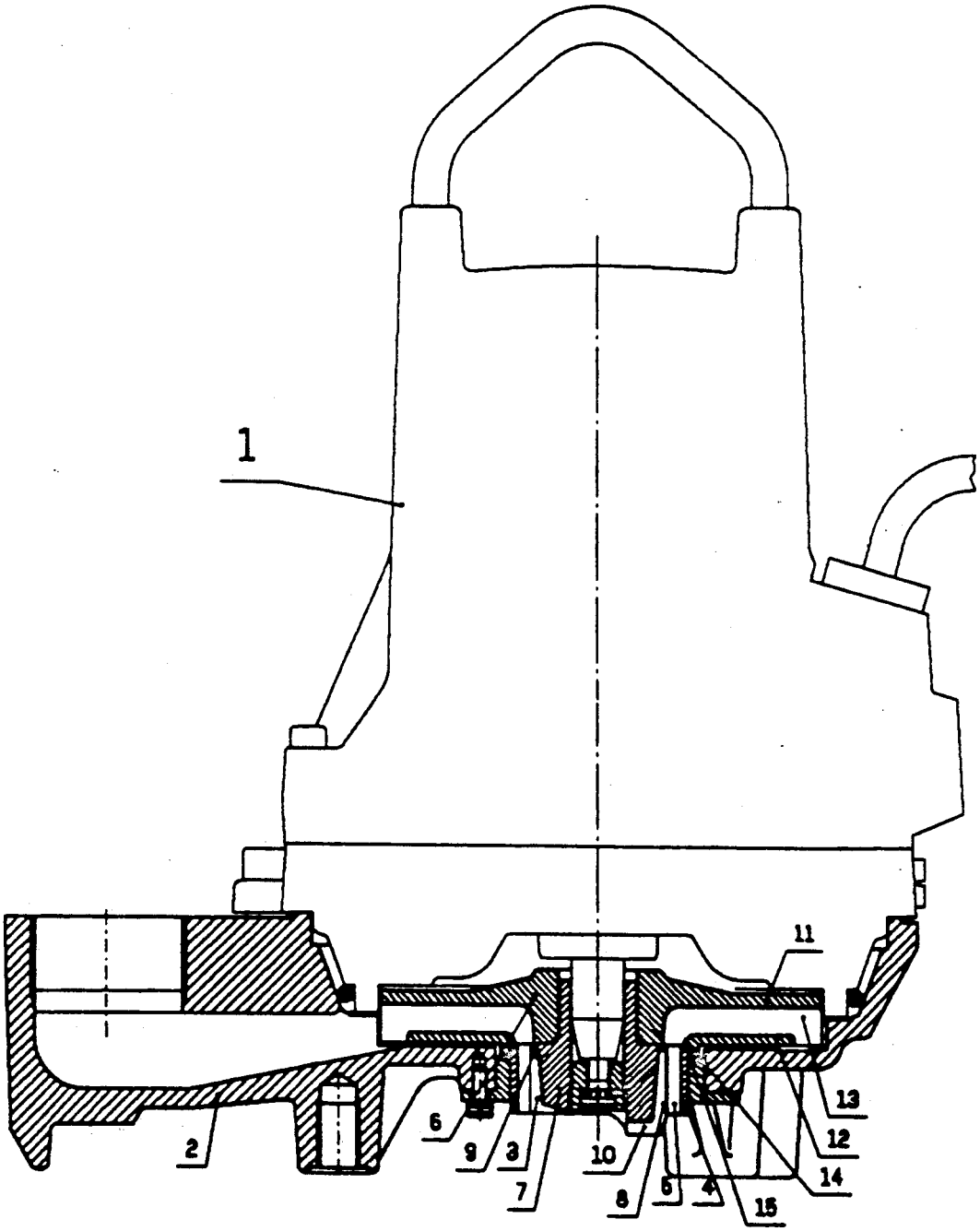
FIG. 1 shows a section view of a submersible pump arrangement according to the invention.
Figure 2:
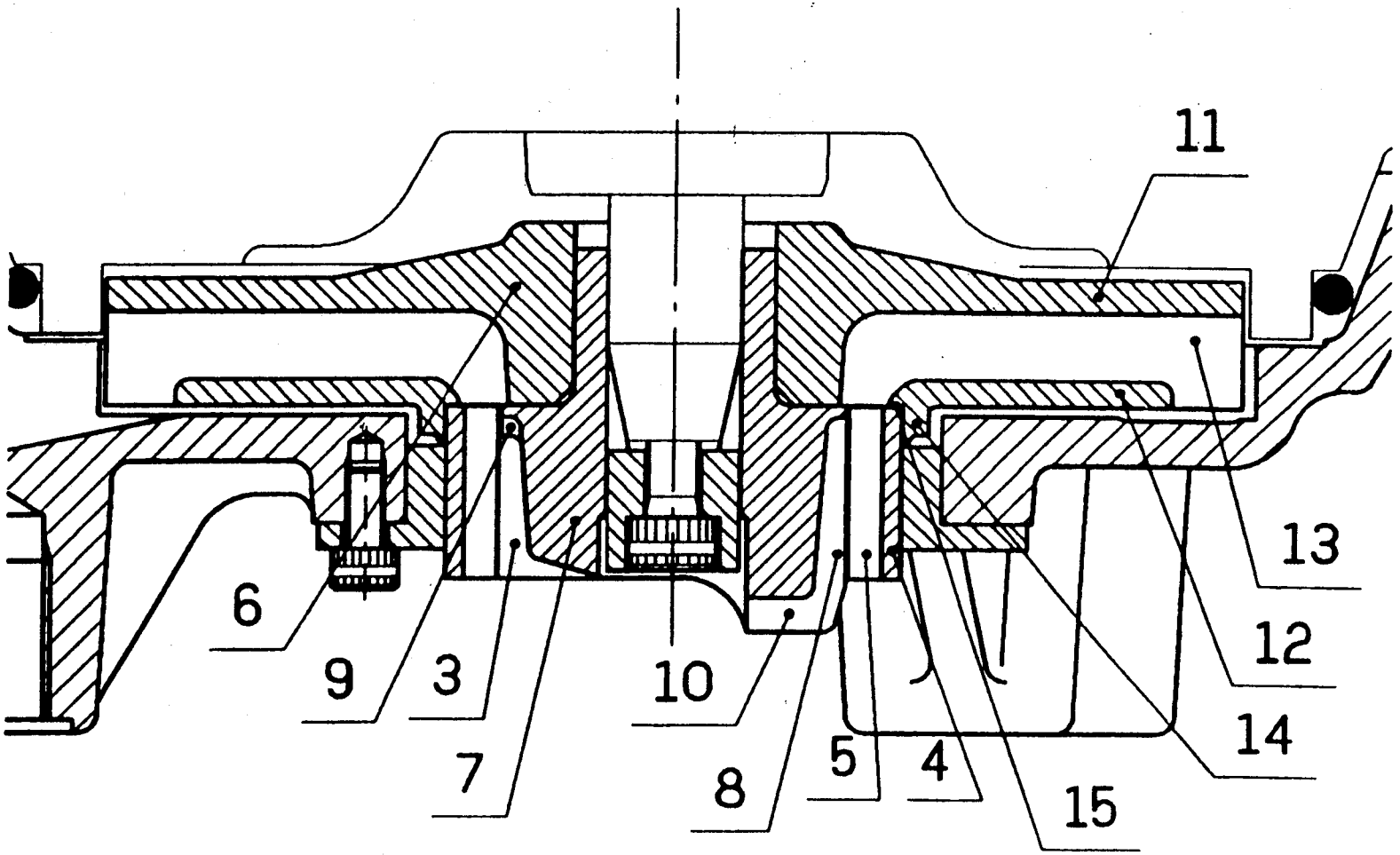
FIG. 2 shows an enlarged view of the arrangement.
Figure 3:
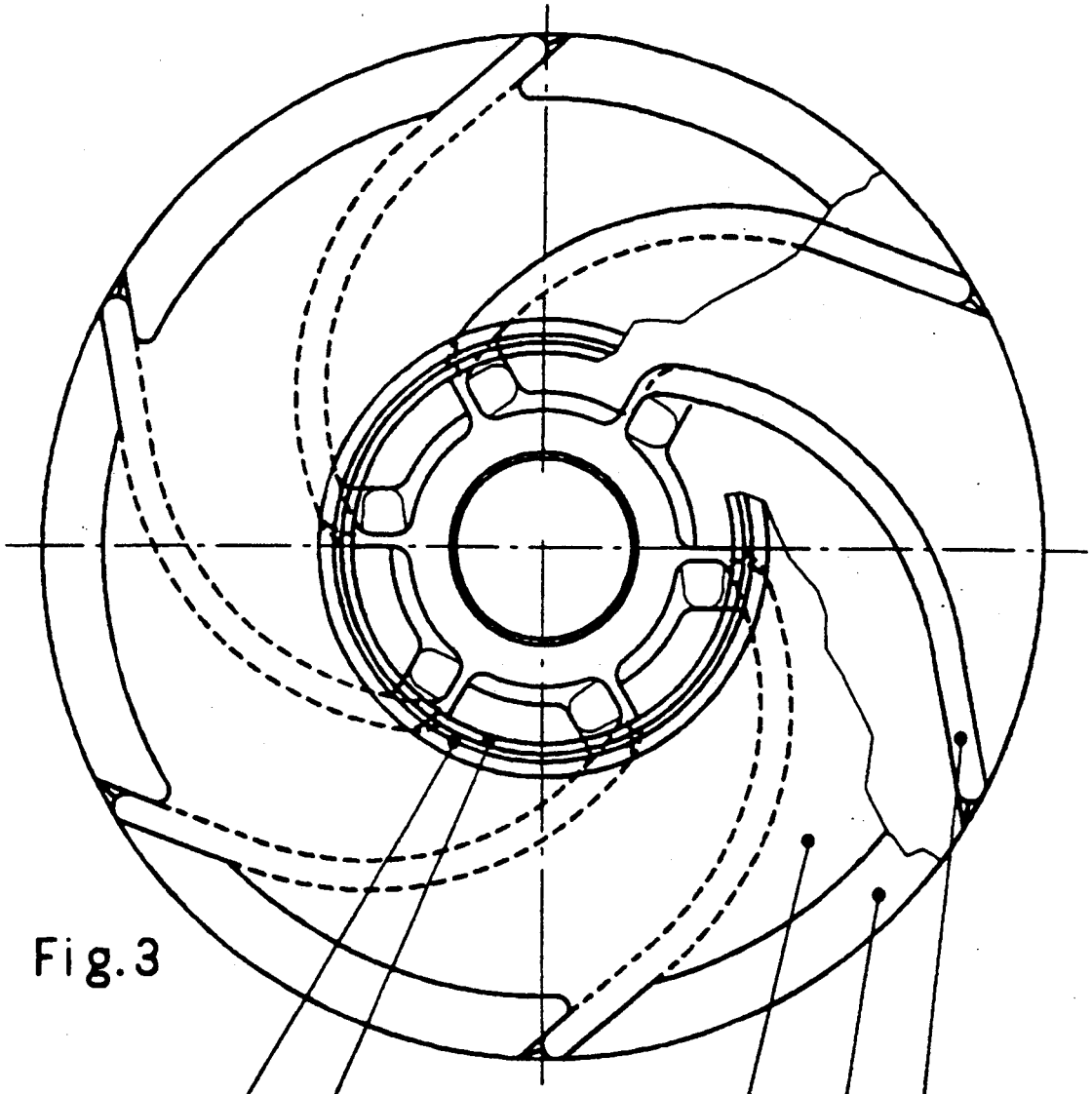
FIGS. 3 and 4 show sectional views of the impeller.
Figure 4:
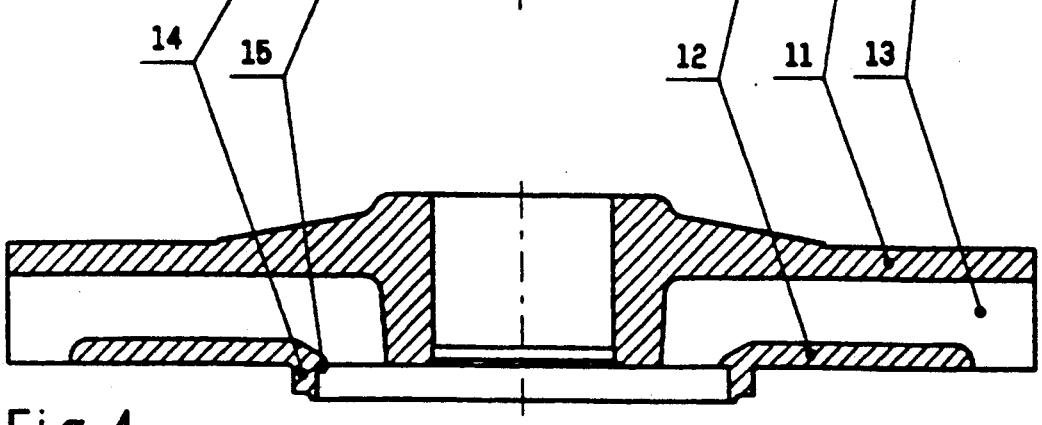

Referring to the drawings, there is shown a pump 1 with a pump housing 2 having an inlet opening with an insert part 4 provided with grooves 5. A centrifugal impeller 6 with inlet hub 7 has primary cutting means 8, secondary cutting means 9 and projections 10. Impeller 6 has upper and lower cover discs 11 and 12 respectively, and vanes 13 with collars 14 and 15 on the lower cover disc 12.

The pump impeller 6 is designed with a cylindrically formed hub 7, which extends downwards into the inlet opening of the pump housing 2. A number of cutting means 8, 9 are arranged on the inlet 7, which cooperate with axially directed grooves 5 in the inlet opening to cut pollutions in the water to be pumped.

The impeller is further designed with two cover discs 11 and 12 and intermediate vanes 13. The cover disc 12, which is adjacent the pump inlet 3, stops a certain distance from the hub 7 thus creating a ringformed opening around the hub, through which opening the pumped medium is sucked into the impeller.

Pollutions in the liquid shall, as previously mentioned, be cut between the cutting means 8, 9 and the grooves 5. The vanes 13 and the insert part 4 provided with the grooves 5 with its end surface create together another cutting means which effectively mills the pollutions. When mounted, the insert part 4 is brought into contact with the inner part of the vanes 13, which provides a suitable cutting distance, when the impeller starts rotating. An additional advantage with the invention is that a correct distance between impeller and insert part is easily and automatically obtained.

In order to insure that the entire amount of cut material is brought into the impeller through the ring-formed opening, the cover disc 12 is provided with a collar 14, which surrounds the upper end of the insert part 4, to provide a radial seal. This seal, which may have a length of between 3 and 6 mm, effectively prevents material from entering along the underside of the cover disc 12 to cause clogging. A similar radial seal is created between the collar 14 and the part of the pump housing 2, which is situated radially outside the collar.

According to a special embodiment the lower cover disc 12 is provided with a collar 15, which extends a distance inwards over the insert part 4, thus creating an axial seal which additionally decreases the risk for the cut material being fed below the cover disc 12.

By means of the invention a pump is provided which has very good qualities when pumping strongly polluted liquids. As compared with previously used open impellers, the closed impeller has a far better efficiency. In addition the risks for clogging and over-load of the driving motor are considerably reduced as all material is cut close to the center of the impeller, resulting in shorter lever arms for the forces and thus less torque. Finally there is no risk for collection of braking material between the impeller and the bottom of the pump housing.

While the present invention has been disclosed in connection with a preferred embodiment thereof, it should be understood that there are other embodiments which fall within the spirit and scope of the invention as defined by the following claims.

I claim:

1. A centrifugal pump for pumping liquids containing solid bodies and pollutions such as rags and other elongated objects and comprising:

a pump housing (2) having a central inlet (3);

a rotating impeller (6) being mounted in said housing and having cutting means (8), (9), and an insert part (4) within the pump inlet (3), said insert part (4) having grooves (5) whereby a cutting takes place between the cutting means (8), (9) and the edges of the grooves (5); said impeller (6) is a closed impeller with upper and lower cover discs (11) and (12) respectively, and intermediate vanes (13); said lower cover disc (12) having a collar (14) which surrounds the end of the insert part (4) heading the impeller (6), to provide a radial seal; and said lower cover disc (12) having a collar extension (15) which extends a distance inwards over the insert part (4), thus creating an axial seal.

2. A centrifugal pump according to claim 1, wherein parts of the vanes (13) which are adjacent to an inlet hub (7) of the impeller (6) create additional cutting means in cooperation with the end of the insert part (4) heading the impeller (6).

3. Centrifugal pump apparatus comprising in combination:

a pump housing (2) having a central inlet (3) and a rotating impeller (6);

cutting means (8), (9) on an inlet hub (7) of said impeller and an insert part (4) of said housing having grooves (5) for cutting between the cutting means and the edges of the grooves;

said impeller (6) being a closed impeller having upper and lower cover discs (11) and (12) respectively and intermediate vanes (13);

said lower cover disc (12) being provided with a collar (14) which surrounds the end of the insert part (4) heading the impeller (6), to provide a radial seal;

said lower cover disc (12) being provided with a collar (15) which extends a distance inwards over the insert part (4), to provide an axial seal; and parts of the vanes (13), which are adjacent to the hub (7) of the impeller (6) create additional cutting means in cooperation with the end of the insert part (4) heading the impeller (6).

* * * * *